US005825848A

United States Patent [19]

Virshup et al.

[11] Patent Number: 5,825,848

[45] Date of Patent: Oct. 20, 1998

[54] X-RAY TARGET HAVING BIG Z PARTICLES IMBEDDED IN A MATRIX

[75] Inventors: Gary Fredric Virshup; Glyn Jeremy Reynolds, both of Cupetino, Calif.

[73] Assignee: Varian Associates, Inc., Palo Alto, Calif.

[21] Appl. No.: 713,550

[22] Filed: Sep. 13, 1996

[51] Int. Cl.[6] ..... H01J 35/08

[52] U.S. Cl. ..... 378/144; 378/143

[58] Field of Search ..... 378/143, 144

[56] References Cited

U.S. PATENT DOCUMENTS 5,148,462 9/1992 Spitsyn et al. ..... 378/143

*Primary Examiner*—Craig E. Church

*Attorney, Agent, or Firm*—Bella Fishman

[57] ABSTRACT

A rotating anode X-ray target has a matrix structure such as a carbon-carbon matrix and a high Z material imbedded inside this matrix structure. The high Z material may be a refractory metal with atomic number at least 72, its alloy or carbide and may be imbedded in the matrix either as discrete particles or as a non-discrete layer. Such a target can be made by any of a number of known methods such as chemical vapor deposition and chemical vapor infiltration. Without a TZM layer or a braze required for holding together an x-ray-producing surface layer and a carbon heat storage material, the target can be made lighter and can be operated at higher temperatures.

29 Claims, 3 Drawing Sheets

X-RAY TARGET HAVING BIG Z PARTICLES IMBEDDED IN A MATRIX

BACKGROUND OF THE INVENTION

This invention relates to an anode X-ray target, and, more particularly, to a rotating target having particles of a high Z material imbedded in a matrix structure such as carbon-carbon matrix.

Prior art X-ray targets are typically comprised of an X-ray-producing top layer of a high Z material such as tungsten or a tungsten-rhenium alloy sintered onto a TZM alloy which is brazed on a carbon backing, say, of graphite. The high Z material at the top is to serve as the source of the X-rays, and its thickness is about 1 mm. One reason for using the TZM layer is for its large hoop strength for keeping the target together while it rotates at speeds up to 10,000 rpm and bulk temperatures over 1100° C., that is, to prevent the carbon backing material and/or the high Z material from flying away while spinning. The carbon backing, with a high specific heat to mass ratio, is used conveniently as a heat storage material because smaller mass of carbon is needed for storing the same amount of heat than of high Z materials. The TZM to graphite braze which holds together the TZM layer and the carbon backing has a temperature limit of about 1100°–1400° C. which is much lower than the temperature reached in the other layer of the target. Should the temperature of the braze rise above its limit, the useful lifetime of the target will be adversely affected. Thus, the temperature limit of the braze has been an important limiting element in the design of an X-ray target. A thicker TZM layer means a longer heat path between the top layer of the high Z material and the braze and hence that the braze can be kept at a lower temperature, but it also means that there is a heavier load on the bearings holding the target as it is rotated at a fast rate.

The deposition of high Z material, and/or alloys or carbides thereof, on top of Carbon or Carbon-Carbon substrates with and without intervening layers is well known in the art. This technology has the disadvantage of being susceptible to peeling or cracking of the top layers, thus reducing the useful life of the X-ray target. When the target surface is bombarded by the X-ray generating electrons, the surface is heated and the temperature will increase dramatically with the top most layers heating the most. The temperature differential between the layers coupled with the differences in thermal expansion coefficients causes high stress to build up, which over time will result in cracking or peeling of the layers. Attempts to alleviate this problem have been to place intervening layers between the substrate and the high Z material containing layers to optimize thermal expansion problems and reduce the stress.

SUMMARY OF THE INVENTION

The present invention reduces the problems of thermal expansion mismatch related peeling and cracking because the mismatched layers will be held together inside of a fiber matrix. When the top layer is heated and begins to expand, it will be held in compression by the fibers, which are then in tension, reducing the ability of the layers to peel. When the top layer is cooled it will contract and fibers will be in compression, another condition which will not promote peeling.

It is therefore an object of this invention to provide an improved rotating anode X-ray target which can be made more compact and lighter.

It is another object of this invention to provide such an X-ray target without a TZM layer, or a similarly heavy layer, to hold together an X-ray-producing top layer and a carbon backing serving as a heat reservoir.

It is still another object of this invention to provide such an X-ray target which does not require the use of a braze with a low temperature limit.

A rotating anode X-ray target embodying this invention, with which the above and other objects can be accomplished, may be characterized as comprising a matrix structure such as comprising a carbon-carbon matrix and a high Z material imbedded in (and not merely deposited upon) this matrix structure. The high Z material may be a so-called refractory metal with an atomic number at least 72, its alloy or carbide, and may be imbedded in the matrix either as discrete particles or as a non-discrete layer. This may be accomplished by any of a number of known methods such as chemical vapor deposition and chemical vapor infiltration.

With an X-ray target thus structured according to this invention with a high Z material imbedded inside a thermally conductive matrix, there is no braze necessary and hence the constraint due thereto according to the prior art technology is removed completely. The subliming temperature of carbon at atmospheric pressure is near the melting point of the refractory metals used for the target. Thus, the peak temperature of a target according to this invention may become higher than it was allowed with a prior art target because, if the refractory metal did melt, it would be contained within the matrix and not change the X-ray characteristics of the target. The carbon-carbon composite target of this invention has a sufficiently high intrinsic hoop strength and hence does not fly apart when rotated at a fast rate. Absence of TZM has the favorable effect of significantly reducing the total weight of the target and hence of decreasing the load on the bearings supporting the rotating target. A preferred example of the matrix material is a carbon-carbon matrix densified with carbon and a high Z material. The matrix can be of any material which allows high enough penetration of electrons and allow encapsulation of the high Z material.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

DETAILED DESCRIPTION OF THE PREFERRED EMBODIMENTS

Figure 1:
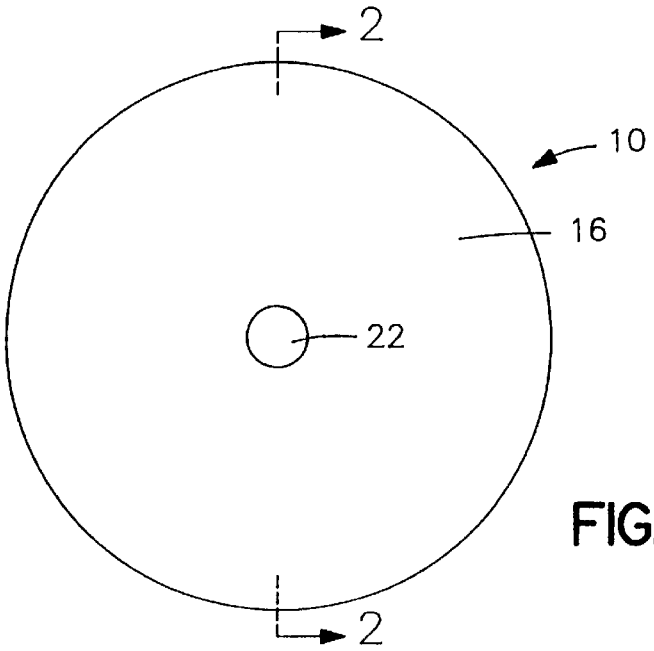
FIG. 1 is a top view of a rotating anode X-ray target embodying this invention.
Figure 2:
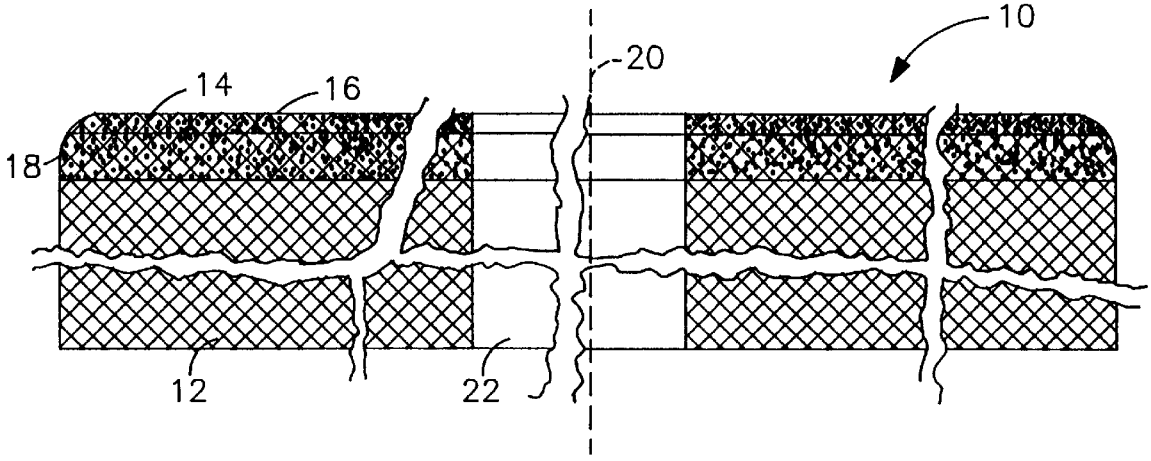
FIG. 2 is a sectional view of the X-ray target of FIG. 1 taken along line 2—2 therein.

FIGS. 1 and 2 show rotating anode X-ray target 10 embodying this invention, comprising a carbon-carbon matrix structure 12 in the shape of a disk (say, with a diameter of 5 inches and thickness of 0.25 inches) having central hole 22 (say, with a diameter of 0.5 inches) for admitting therethrough a drive shaft of a rotating means for causing target 10 to rotate around the axis of rotation defined by central axis of symmetry 20 of the disk. The matrix of carbon-carbon composite of matrix structure 12 is indicated in FIG. 2 by a lattice of diagonally drawn lines, but this is intended to be a schematic, and not realistic, representation. Alternatively, a thermally conductive ceramic matrix, capable of being impregnated with particles, as will be described below, may be used instead of a carbon-carbon matrix for the purpose of this invention.

Discrete particles containing a high Z material such as hafnium carbide are imbedded into matrix of structure 12 as indicated schematically by small dots in FIG. 2, the changing darkness of the shading (or the density of the dots) being indicative of the gradual variation in the density of these particles. As shown in FIG. 2, high-density layer 14 of thickness about 0.005 inches is formed inside matrix structure 12 at one externally exposed surface 16 thereof (referred to as the "top surface") with the density of the high Z material sufficiently large such that X-rays with intensity useful for a specified purpose can be generated when target 10 is used in a X-ray tube and its top surface is bombarded with a beam of accelerated electrons in a known manner of X-ray generation.

Formed adjacent to high-density layer 14 toward the interior of matrix structure 12 is grading layer 18 with thickness about 0.01 inch which comprises the carbon-carbon matrix densified with carbon and the high Z material and wherein the density of the high Z material gradually decreases from the side proximal to high-density layer 14 to the opposite side which abuts the bottom layer densified with carbon but not containing any high Z material.

Target 10 thus structured is incorporated in an X-ray tube of a known kind opposite a cathode (not shown) serving as a source of an electron beam. An appropriate voltage is applied between the electron-emitting cathode and target 10 which serves as an anode. Target 10 is caused to rotate around its axis of symmetry 20 by a rotating means (not shown) passing through central hole 22, as described above, and the beam of electrons emitted from the cathode and accelerated by the voltage difference between the cathode and the anode is caused to bombard target 10 over a spatially fixed area (not shown) through which top surface 16 passes as target 10 is rotated around axis of symmetry 20.

Although the invention has been described above with reference to only one example, this example is not intended to limit its scope. Many modifications and variations are possible within the scope of the invention, although not all such modifications and variations are separately illustrated. For example, the generally disk-shaped matrix structure 12 need not have a flat top surface, as shown in FIG. 2, but may include an outwardly sloped peripheral portion. Throughout herein, the expression "high Z material" is intended to be interpreted broadly. It is intended to include all elements which have a sufficiently large atomic number and have been used as a material for a target for X-ray generation by the bombardment of high-energy electrons thereon. Preferred examples of "the high Z material", as the expression is used herein, include metallic elements with the atomic number at least 72, their alloys and carbides, known to be refractory, or as having a relatively high melting temperature. Such elements include hafnium, tantalum, tungsten, rhenium, osmium and iridium. Some higher Z elements such as platinum and gold, although they have lower melting points than the metals which are commonly referred to as refractory metals, are also included within the scope of this invention.

Figure 3:
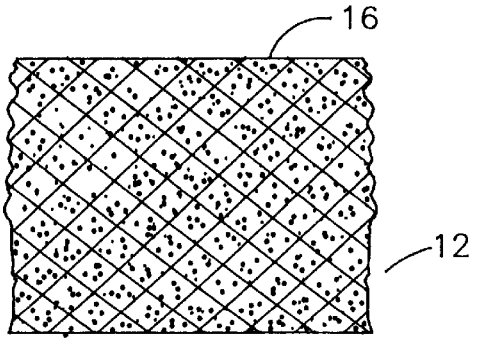
FIGS. 3–15 are sectional views each of a portion of a different X-ray target embodying this invention to show their layer structures.

Although the invention was described above with reference to an example wherein discrete particles containing a high Z material are imbedded within a matrix to thereby form a high-density layer with a substantially constant density of the high Z material and a grading layer with a density gradient, the high Z material need not be imbedded in the matrix as discrete particles, but may be in a non-discrete form. The grading layer of the kind indicated by numeral 18 in FIG. 2 is not essential, and the high Z material may be distributed uniformly throughout inside the matrix structure (with density sufficiently large to generate desired X-rays) as shown in FIG. 3. Because accelerated X-ray producing electrons travel approximately 20 times deeper into carbon than into a typical high Z material, the high Z particles may be diluted by the carbon matrix down to about 5% by volume of the matrix. Alternatively, for example, a layer containing rhenium may be formed above another layer containing carbon.

Figure 4:
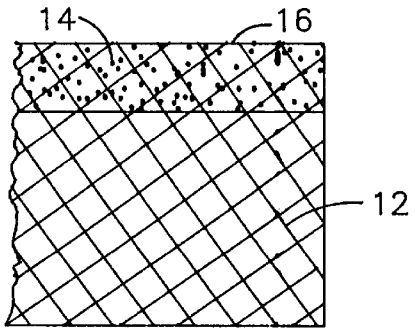
Figure 5:
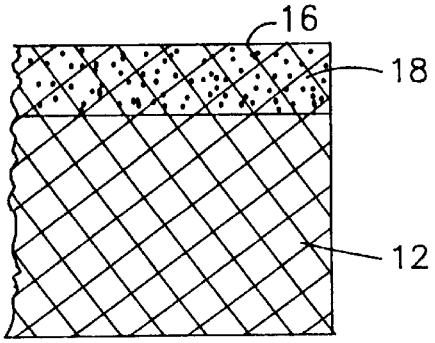
Figure 6:
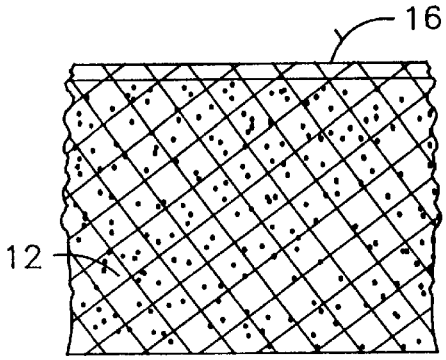
Figure 7:
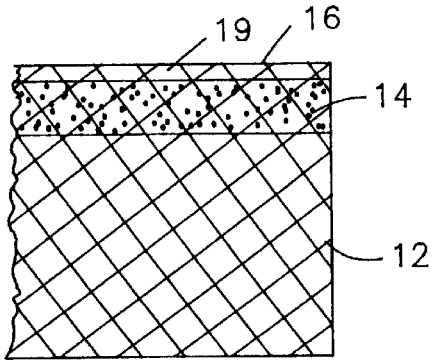
Figure 8:
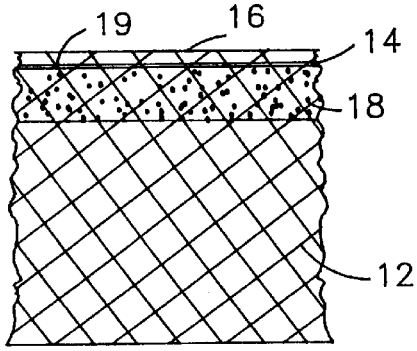
Figure 9:
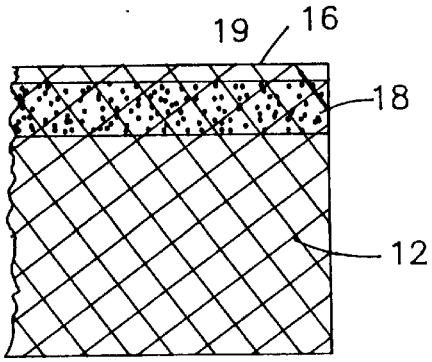
Figure 10:
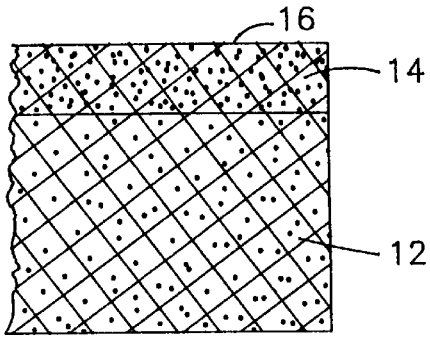
Figure 11:
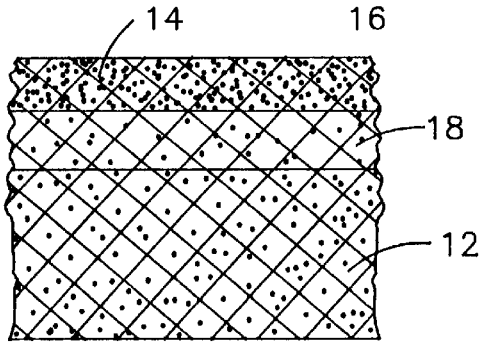
Figure 12:
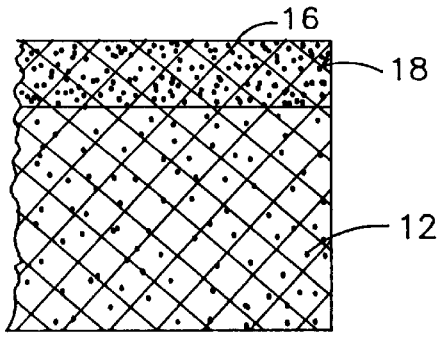
Figure 13:
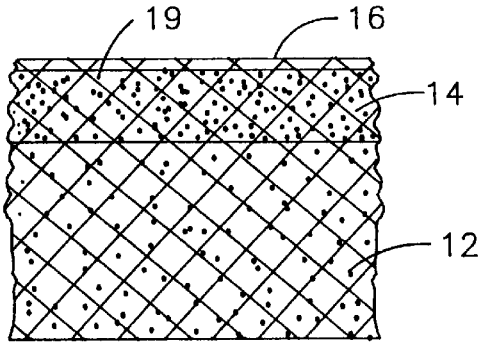
Figure 14:
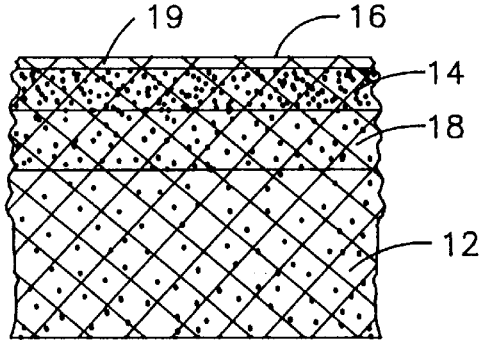
Figure 15:
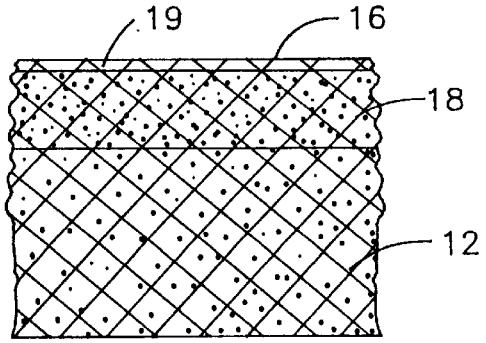

FIGS. 4–15, wherein layers which are at least comparable to those explained above with reference to FIGS. 2 and 3 are indicated by the same numerals, show other examples which are intended to be within the scope of this invention. FIG. 4 shows an example characterized as having a uniform distribution of a high Z material in top layer 14 with little of no high Z material in the bulk of matrix structure 12. The density of the high Z material in the top layer is large enough to generate X-rays of intended intensity. FIG. 5 shows another example having grading layer 18 disposed above the bulk of matrix 12. Density of high Z material gradually increases within grading layer 18 on bulk of matrix structure 12 to top surface 16 where it is sufficiently large to generate X-rays. FIGS. 6–9 are examples which are similar respectively to those shown in FIGS. 3, 4, 2 and 5 but are each characterized as having top low-Z layer 19 of a low Z material which is thin enough to allow the passage of electrons. FIGS. 10–12 are examples which are similar respectively to those shown in FIGS. 4, 2 and 5, characterized wherein a high Z material is also uniformly distributed throughout the bulk of matrix structure 12 although its density is much less than inside the top high-density layer 14 shown, for example, in FIGS. 2 and 8. FIGS. 13–15 are examples which are similar respectively to those shown in FIGS. 10–12 but are each characterized as having a top low-Z layer as shown in FIGS. 6–9.

It is further to be reminded that this invention is not limited by the method by which the high Z material is imbedded in the matrix structure. A high Z material may be caused to be imbedded inside a matrix structure to form an X-ray target according to this invention, for example, by infiltrating a carbon-carbon woven mesh with the high Z material during its densification by using any of the known techniques such as chemical vapor deposition, chemical vapor infiltration and pitch densification. Another method is by infiltrating a carbon pitch with a high Z material before densification and later adding a carbon-carbon wrap to increase the strength. Still another method is by infiltrating and densifying a porous carbon substrate with carbon and a high Z material. A further example is by deposition of pyrolitic graphite on a carbon substrate followed by chemical vapor deposition of a thin layer of high Z material on the pyrolitic graphite. For any of these methods, the high Z material may be introduced as particles in powder form, by chemical vapor deposition, by physical vapor deposition or by chemical vapor infiltration.

It is also well understood that all disclosed X-ray target structures having high Z particles imbedded in a matrix may be successfully implemented into an anode assembly with a stationary target.

Currently, many X-ray tubes are used in applications where high Z material (where Z is at least 72) anodes are not required, for example, in X-ray diffraction analysis. It is inherently apparent that the technique described herein could equally well be used to fabricate a target impregnated with materials such as Fe, Cu, Mo, which are typically used in analytical X-ray equipment.

In summary, all such modifications and variations to the described example that may be apparent to a person skilled in the art, are intended to be within the scope of this invention.

What is claimed is:

1. An X-ray target comprising:

a matrix structure; and a high Z material, said high Z material being imbedded inside said matrix structure.

2. The X-ray target of claim 1, wherein said matrix structure comprises a matrix of a carbon-carbon composite material.

3. The X-ray target of claim 1, wherein said high Z material is at least one selected from the group consisting of elements capable of producing X-rays by electron bombardment thereon, alloys thereof and carbides thereof.

4. The X-ray target of claim 3, wherein said high Z material is at least one selected from the group consisting of tungsten, rhenium, tantalum, osmium, iridium, and hafnium, alloys thereof and carbides thereof.

5. The X-ray target of claim 2, wherein said high Z material is at least one selected from the group consisting of elements with atomic numbers at least 72, alloys thereof and carbides thereof.

6. The X-ray target of claim 5, wherein said high Z material is at least one selected from the group consisting of tungsten, rhenium, tantalum, osmium, iridium, and hafnium, alloys thereof and carbides thereof.

7. The X-ray target of claim 6, wherein said high Z material comprises particles which are distributed uniformly throughout said matrix structure.

8. The X-ray target of claim 7, wherein X-ray target further comprising a top layer of low Z material, said top layer allows the passage of electrons therethrough.

9. The X-ray target of claim 8, wherein said particles of said high Z material is diluted by said matrix to no less than 5% in volume of said matrix.

10. The X-ray target of claim 8, wherein said matrix structure includes a grading layer having an inner surface and an outer surface, and wherein said particles of said high Z material are distributed throughout said grading layer with density gradually increasing from said inner surface to said outer surface.

11. The X-ray target of claim 10, wherein the density of said particles of said high Z near said outer surface is large enough to generate X-rays of a useful intensity.

12. The X-ray target of claim 10, wherein said matrix structure further includes a top layer over said outer surface of said grading layer, the density of said particles of said high Z material inside said top layer being substantially constant.

13. The X-ray target of claim 6, wherein said matrix structure further comprising a layer with inside and outside surfaces and a bulk adjacent to said inside surface, whereby said high Z material comprises particles which are distributed within said layer so as the density of said high Z material is sufficient enough to generate X-rays of useful intensity.

14. The X-ray target of claim 13, wherein said bulk comprises a grading layer adjacent to said layer with said particles distributed nonuniformly therein.

15. The X-ray target of claim 13, wherein the density of said particles of said high Z material is gradually increases from the inside surface to the outside surface of said layer.

16. The X-ray target of claim 15, further comprising a top layer of low Z material adjacent to the outside surface of said layer, said top layer allows the passage of electrons therethrough to generate X-rays of useful intensity.

17. The X-ray target of claim 13, wherein said particles of said high Z material distribute uniformly within said layer.

18. The X-ray target of claim 17, further comprising a top layer of low Z material adjacent to the outside surface of said layer, said top layer allows the passage of electrons therethrough to generate X-rays of useful intensity.

19. A method of making an X-ray target, said method comprising the steps of:

providing a matrix structure with a top surface; and causing a high Z material capable of producing X-rays by electron bombardment on said top surface to be imbedded in said matrix structure.

20. The method of claim 19, wherein said matrix structure comprises a matrix of a carbon-carbon composite material.

21. The method of claim 19, wherein said high Z material is at least one selected from the group consisting of elements with atomic numbers at least 72, alloys thereof and carbides thereof.

22. The method of claim 21, wherein said high Z material is at least one selected from the group consisting of tungsten, rhenium, tantalum, osmium, iridium, and hafnium, alloys thereof and carbides thereof.

23. The method of claim 22, wherein said high Z material is contained in discrete particles which are imbedded in said matrix structure.

24. The method of claim 22, wherein discrete particles are dispersed in said matrix structure such that there is at least a high density layer inside said matrix structure, said high Z material being distributed uniformly throughout said high density layer, the density of said high Z material within said high density layer being sufficient to generate X-rays of a useful intensity.

25. The method of claim 22, wherein discrete particles are dispersed in said matrix structure such that at least one grading layer is formed, said discrete particles containing said high Z material being distributed throughout said grading layer with density gradually increasing towards said top surface.

26. The method of claim 19, wherein said matrix structure comprises a woven mesh and said high Z materials are caused to be imbedded in said matrix structure by infiltrating said woven mesh of said matrix structure with said high Z material during a densification process for said woven mesh by a technique selected from the group consisting of chemical vapor deposition, chemical vapor infiltration and pitch densification.

27. The method of claim 26, wherein said high Z material is at least one selected from the group consisting of elements with atomic numbers at least 72, alloys thereof and carbides thereof.

28. An X-ray target comprising:

a matrix structure; and a material selected from the group consisting of elements capable of producing X-rays by electron bombardment thereon, alloys thereof and carbides thereof, said material being imbedded inside said matrix structure.

29. The X-ray target of claim 28 wherein said matrix structure comprises a matrix of a carbon-carbon composite material, and said material is at least one selected from the group consisting of copper, iron, molybdenum and nickel, alloys thereof and carbides thereof.

* * * * *

UNITED STATES PATENT AND TRADEMARK OFFICE

CERTIFICATE OF CORRECTION

PATENT NO. : 5,825,848

DATED : October 20, 1998

INVENTOR(S) : Gary F. Virshup and Glyn J. Reynolds

It is certified that error appears in the above-identified patent and that said Letters Patent is hereby corrected as shown below:

Cover page, [54], "BIG" should read -- HIGH --.
Column 1, line 1, "BIG" should read -- HIGH --.

Signed and Sealed this

Twenty-third Day of March, 1999

*Attest:*

Q. TODD DICKINSON

*Attesting Officer*

*Acting Commissioner of Patents and Trademarks*